United States Patent [19]

Sinclair et al.

[11] Patent Number: 5,033,933

[45] Date of Patent: Jul. 23, 1991

[54] CARTON CLAMP FOR A LIFT TRUCK

[75] Inventors: Stuart W. Sinclair, Lake Jackson; Carl A. Morris, Jr., Sugarland, both of Tex.

[73] Assignee: Long Reach Holdings, Inc., Houston, Tex.

[21] Appl. No.: 494,192

[22] Filed: Mar. 15, 1990

[51] Int. Cl.[5] ..... B66F 9/18

[52] U.S. Cl. ..... 414/607; 294/87.1; 294/119.1; 414/621

[58] Field of Search ..... 294/87.1, 99.1, 119.1; 414/607, 608, 621, 623, 785

[56] References Cited

U.S. PATENT DOCUMENTS

| | | | |
|---|---|---|---|
| 2,681,162 | 6/1954 | Ehmann | 414/621 |
| 2,727,779 | 12/1955 | Phillips | 294/99.1 |
| 2,782,066 | 2/1957 | Lord | 294/119.1 X |
| 2,819,113 | 1/1958 | Phillips | 294/99.1 X |
| 2,956,700 | 10/1960 | Quayle | 294/99.1 X |
| 3,145,866 | 8/1964 | Farmer et al. | 294/119.1 X |
| 3,182,837 | 5/1965 | Farmer et al. | 294/119.1 X |
| 3,370,880 | 2/1968 | Carliss et al. | 414/621 X |
| 3,400,965 | 9/1968 | Olson | 414/621 X |
| 4,540,211 | 9/1985 | Masserang | 294/99.1 X |

*Primary Examiner*—Robert J. Spar
*Assistant Examiner*—Brian K. Dinicola
*Attorney, Agent, or Firm*—Fulbright & Jaworski

[57] ABSTRACT

A carton clamp load having a pad on the inner side for clamping a load, a first spring beam positioned outside of the pad and supported from its back end, and a second spring beam positioned outside of the first beam and supported at its back end. A uniform distribution of load is provided by supporting the front end of the pad adjacent the front ends of the first and second beams and supporting the back end of the pad vertically from the first beam and horizontally from the second beam.

6 Claims, 3 Drawing Sheets

FIG.1
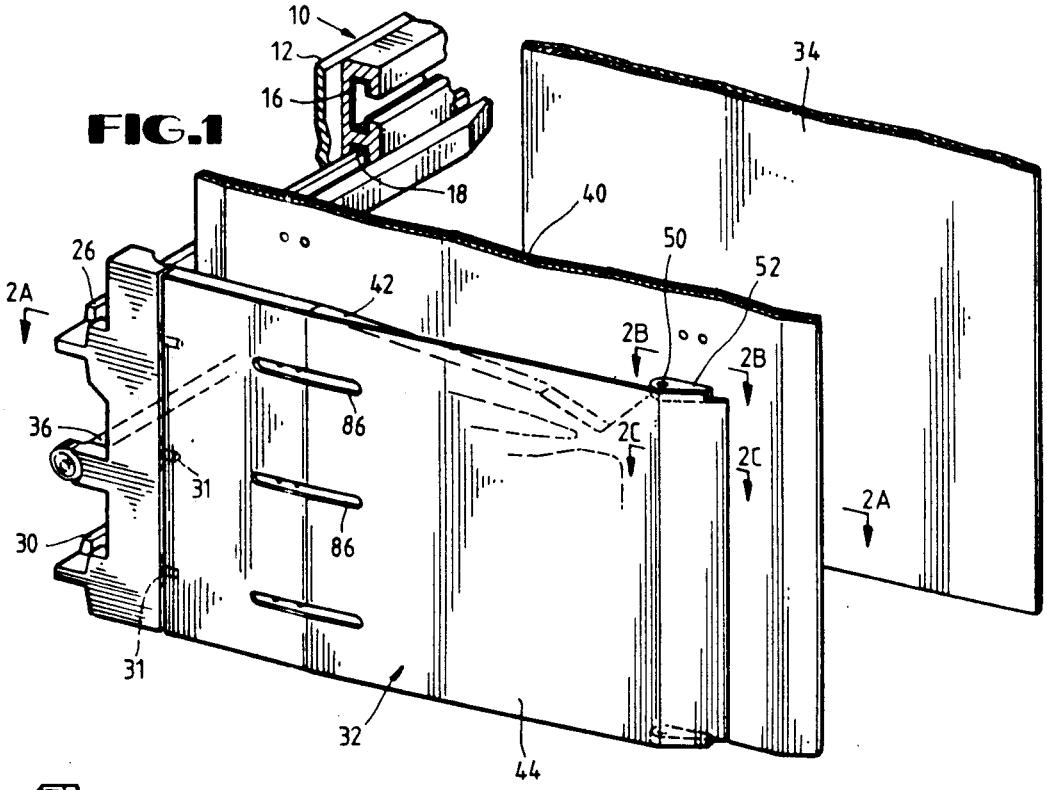
FIG.2B
FIG.2C
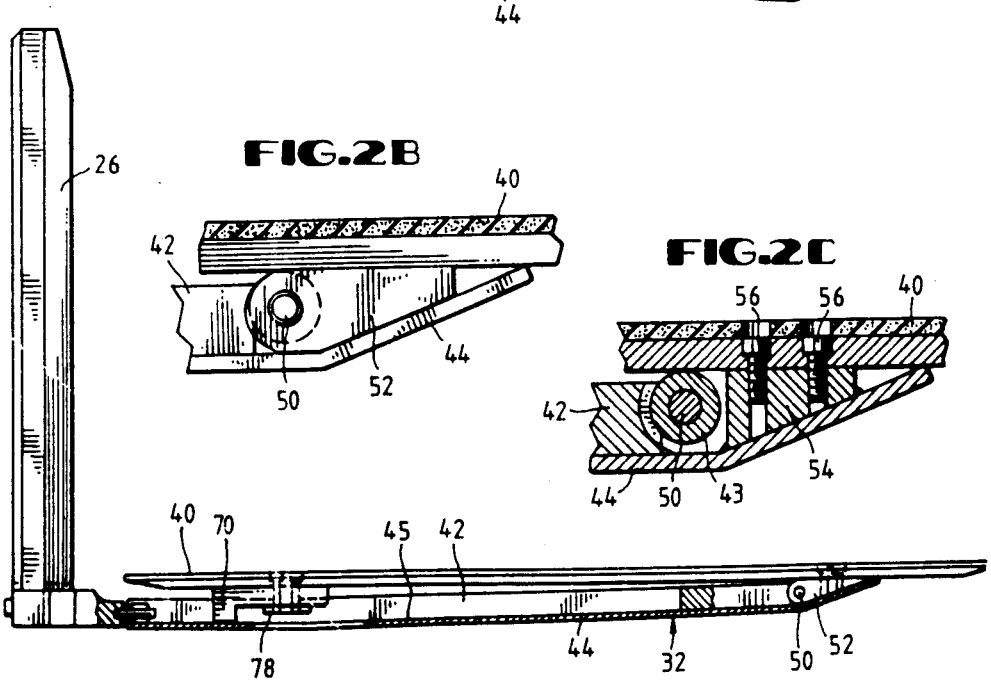
FIG.2A

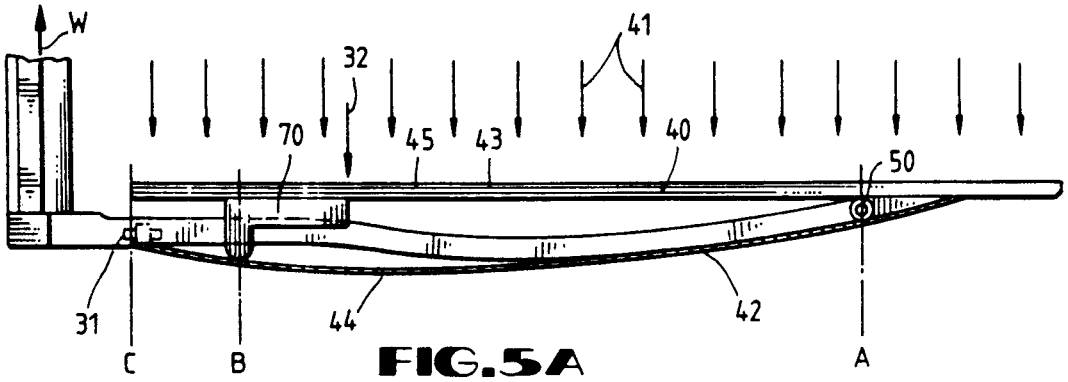
FIG.5A
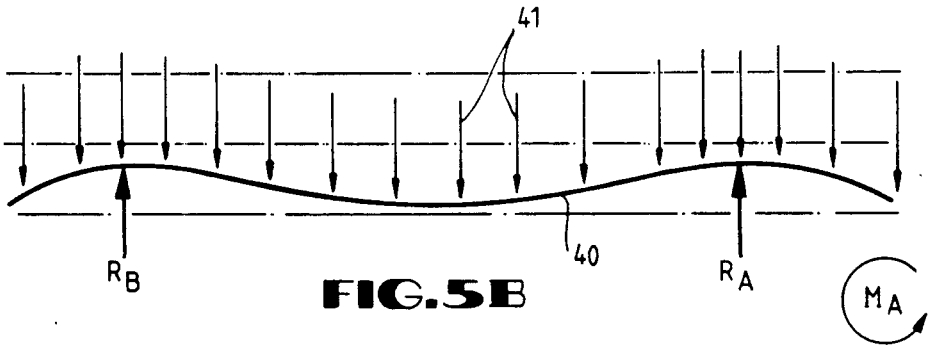
FIG.5B
FIG.5C
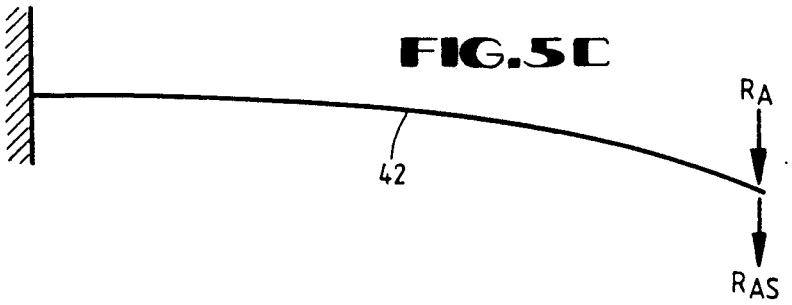
FIG.5D
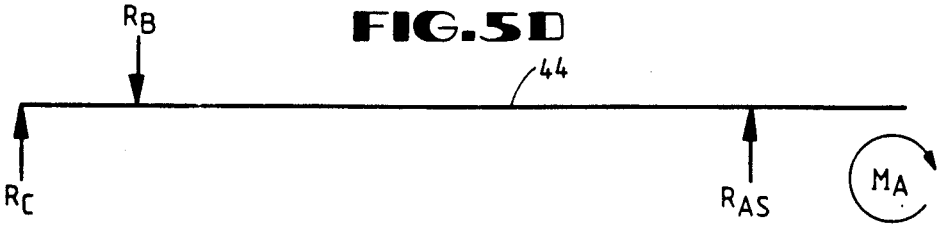

CARTON CLAMP FOR A LIFT TRUCK

BACKGROUND OF THE INVENTION

Various types of carton clamps have been proposed for use with lift trucks in order to provide damage-free clamping, particularly with unitized case loads. The proposals have included arm camber, and toe-in and articulating arm designs. The present invention is directed to a carton clamp having clamp arms which apply an equal pressure over the entire pad surface meaning that every tier of the load supports its own weight and allows the pads to grip cartons firmly, but gently. The equal pressure design of the present invention not only implements a vertical, but also the more importantly horizontal (front to back) distribution of pressure on the load/cases.

SUMMARY

The present invention is directed to a carton clamp arm in a load carrying clamp attachment for use in a lift truck in which the arm has a back and a front end, and an inner side and an outer side. The back end is supported from a slide and the inner side is positioned to engage a load. The arm includes a pad on the inner side of the arm for clamping a load, a first spring beam positioned outside of the pad and connected at its back end to a slide, and a second spring beam positioned outside of the first beam and connected at its back end to a slide. The front end of a pad is supported vertically and horizontally in a vertical plane adjacent the front ends of the first and second beams. The back end of the pad is supported vertically in a vertical plane from the first beam and the back end of the pad is supported horizontally in a vertical plane from the second beam. This structure provides a preload and even force distribution over the pad.

Still a further object is wherein the front end of the pad is supported in a vertical plane adjacent to but spaced from the front end of the pad and the back end of the pad is supported in a vertical plane adjacent to but spaced from the back end of the pad.

Still a further object of the present invention is wherein the front ends of the first and second spring beams are positioned nearer to the inside of the arm than the rear ends of the first and second spring beams providing a cantilever spring force at the front end of the pad to provide a preload force.

Still a further object of the present invention is wherein the horizontal support of the back end of the pad by the first beam is adjustable between the front and back ends for fine tuning the distribution of forces on the load.

Still a further object is wherein a fulcrum is supported from the pad and is engagable against the inside of the second beam and the position of the fulcrum is adjustable between the ends of the arm.

Still a further object is wherein a fulcrum stop and a fulcrum limit is provided adjacent the rear end of the arm in which the stop is on the first beam and the fulcrum limit is positioned between the first and second beams and connected to the pad and positioned to engage the stop and limit inward movement of the pad.

Yet still a further object of the present invention is wherein each of the first and second beams includes a concave curved portion facing inside.

Other and further objects, features and advantages will be apparent from the following description of a presently preferred embodiment of the invention, given for the purpose of disclosure, and taken in conjunction with the accompanying drawings.

BRIEF DESCRIPTION OF THE DRAWINGS

FIG. 1 is a fragmentary, elevational, perspective view, of the carton clamp attachment of the present invention for use on a lift truck, FIG. 2A is a cross-sectional view, taken along the line 2A—2A of FIG. 1, FIG. 2B is an enlarged cross-sectional view, taken along the line 2B—2B of FIGS. 1 and 3, FIG. 2C is an enlarged cross-sectional view, taken along the line 2C—2C of FIGS. 1 and 3, FIG. 5A is a schematic cross-sectional elevational view of the clamp arm like FIG. 2 but illustrating the components and the distribution of a uniform load on the pad of the arm, FIG. 5B is a graph illustrating the deflection of the pad of the clamp arm upon the application of a uniform distributed load, FIG. 5C is a schematic graph of the load application on the first spring beam of the present invention, and FIG. 5D is a graph illustrating the load application on the second spring beam of the clamp arm of the present invention.

DESCRIPTION OF THE PREFERRED EMBODIMENT

Figure 3:
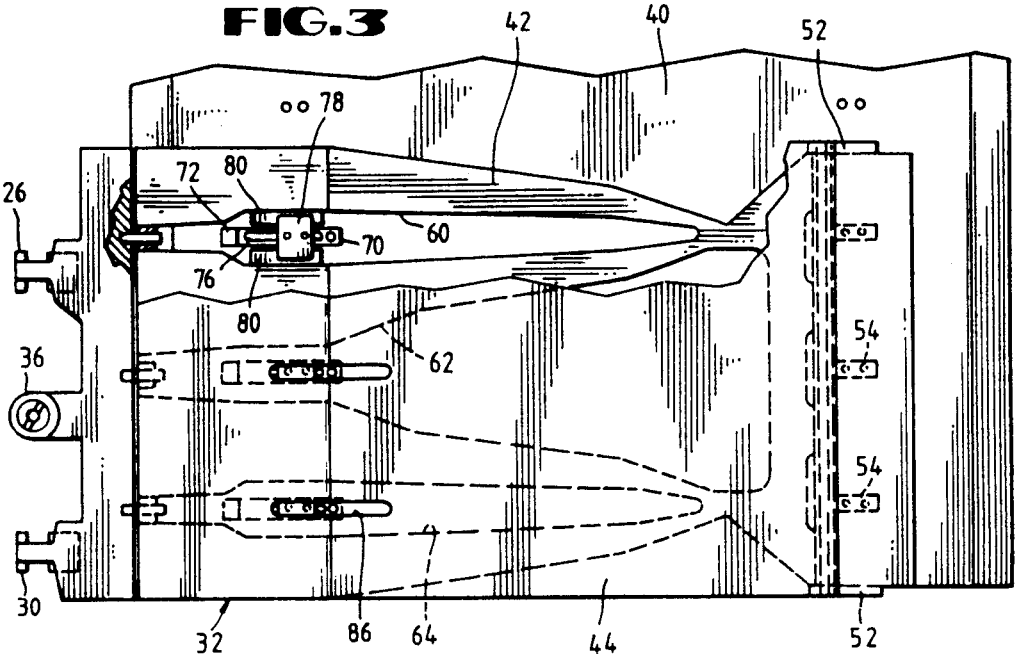
FIG. 3 is an enlarged elevational view, partly fragmentary, and partly in cross section, of a clamp arm of the present invention.

Referring now to the drawings, and particularly to FIGS. 1, 2A and 3, the reference numeral 10 generally indicates the load carrying clamp attachment of the present invention which is adapted to be mounted on a lift truck for picking up, carrying and releasing carton types of loads. The attachment 10 includes a body 12 having mounting hooks (not shown) which are adapted to be carried from a lift truck (not shown). The body includes a plurality of elongate vertically spaced parallel guides, normally four, but which only guides 16 and 18 are shown. Each of the guides supports a longitudinal movable slide. First and second carton load clamp arms 32 and 34 are provided for gripping, carrying and releasing carton types of loads. The clamp 32 is connected to one or more slides, such as slides 26 and 30, which longitudinally move in one of the guides. Similarly, clamp 34 is connected to two slides movable in coacting guides. A piston and cylinder assembly, such as 36 which is connected to clamp 32, is connected to each of the load clamps 32 and 34 for movement of the clamps towards and away from each other.

The above general description of a carton carrying clamp attachment from a lift truck is known. The present invention is directed to a carton clamp arm which provides an even force distribution when clamping unitized loads of cartons. While the clamp arm 32 will be described in detail, its coacting arm 34 will not be described as it is merely an identical mirror image of arm 32.

The arm 32 includes a back end attached to and supported from its slides 26 and 30, an opposite front end, an inner side for engaging a load, and an outer side opposite to the inner side. The arm 32 is generally includes three main parts, a pad 40 on the inner side of the arm 32 for clamping a load, a first spring beam 42 positioned outside of the pad 40 and connected at its back end and supported from the slides 26 and 30, and a second spring beam 44 positioned outside of the first beam 42 and connected at its back end and supported from the slides 26 and 30 by pins 31.

The arm 32 extends from the back end to the front end in a horizontal outwardly extending plane and extends in a vertical plane for coacting with cartons. No arm camber or toe-in is required in the present invention.

The pad 40 may be of conventional materials such as a grooved rubber covered aluminum contact pad. Referring now to FIGS. 5A and 5B, the pad 40 is generally a simply supported beam supported at vertical points along parallel vertical planes A and B. The pad 40 preferably has generally equal over-hanging ends extending beyond the support planes A and B such that when uniformly loaded, as indicated by the arrows 41, provides a deflection at both ends and at the center which are all equal, as best seen in FIG. 5B.

The first spring beam 42, as best seen in FIGS. 5A and 5C, is a cantilevered beam supported and fixed at its back end at plane C (parallel to planes A and B) and is loaded in a horizontal direction along plane A by load-induced reaction forces of the pad 40 and of the outer spring beam 44. Also the beam 42 vertically supports the pad 40 along vertical points in both planes A and B.

The second spring beam 44 is supported in a vertical plane near and parallel to or coincidental with the plane C bY pins 31 and is fixedly secured along the vertical plane A by attachment to the pad 40. In addition, the second spring beam 44 provides a horizontal force against the pad 40 at the plane B. As will be more fully discussed, the vertical support plane B may be moved between the rear end and the the front end of the arm 32 for fine tuning the loading on the pad 40.

Referring now to FIGS. 1 through 4, the details of construction and attachment and interconnection between the pad 40, the first beam 42 and the second beam 44 is best seen. The front end of the first beam 42 is secured through the pivot hinge 43 to a vertical rod 50 (vertical plane A) which in turn is connected to supports 52 at each end which in turn are welded to the second beam 44. Intermediate the supports 52, as best seen in FIGS. 2C and 3, a plurality of supports 54 are welded to the inside of the second beam 44 and are connected such as by bolts 56 to the pad 40. It is to be noted that both the spring beams 42 and 44 have a front end which are positioned nearer to the inside of the arm 32 than the rear ends of the first and second spring beams 42 and 44. That is, preferably, the beams 42 and 44 include a concave curved portion 43 and 45, respectively, facing inside which provides a pre-load adjacent the front end of the pad 40.

Figure 4:
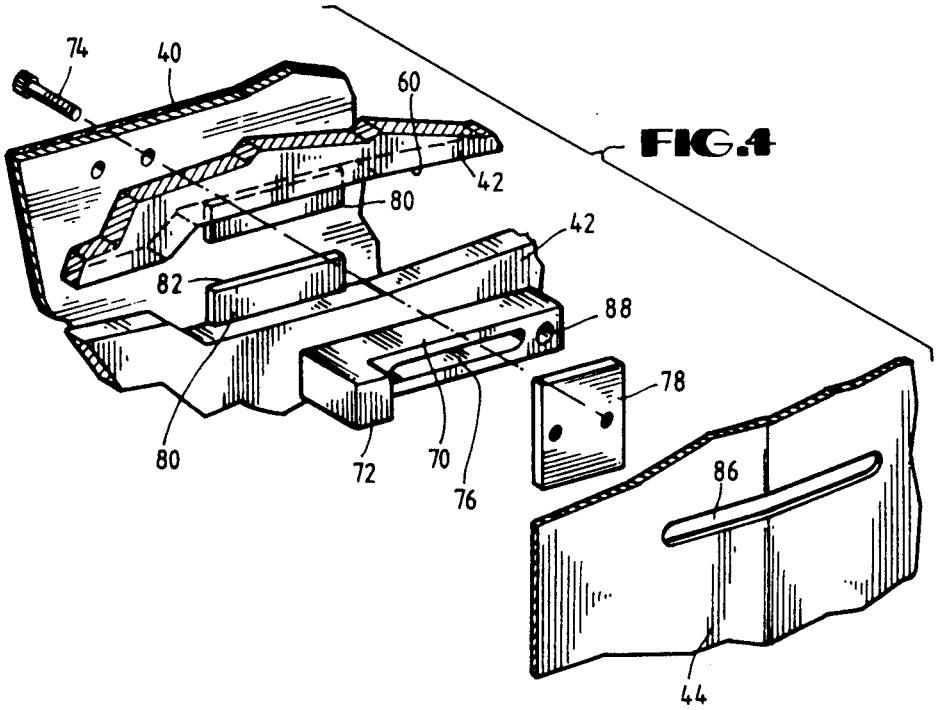
FIG. 4 is a fragmentary, exploded, perspective view of the coacting supporting structure adjacent the rear end of the clamp arm of FIG. 3.

Referring now to FIGS. 2A, 3 and 4, the vertical and horizontal loading of the pad 40 at the plane B is best seen. The first beam 42 includes a plurality of openings 60, 62 and 64. A fulcrum 70 is connected to the pad 40, is positioned in each of the openings in the first beam 42, and includes an anvil 72 which engages the inside of the second beam 44. The anvil 72 by engaging the spring-loaded beam 44 provides horizontal loading force for the pad 40 adjacent the plane B. The anvil 70 is held in place against the inside of the pad 40 by a plurality of bolts 74 which extend through an elongate opening 76 in the fulcrum 70 and are threaded into a fulcrum limit plate 78. The fulcrum limit plate 78 is positioned in each opening, such as the opening 60 in the first beam 42. In addition, a fulcrum plate stop 80 is provided connected to the first beam 42 on either side of each opening. The space 82 between the stops 80 allow the passageway of the fulcrum 70 but not the limit plate 78. The fulcrum limit 78 provides the function of vertically supporting the back end of the pad 40 from the first beam 42. The limit plate 78 also upon contacting the fulcrum stops 80 prevents inward movement of the back end of the pads 40. This in turn prevents the outward pivoting of the front ends of the pads 40 when they have engaged a load thereby preventing losing the load.

In order to fine tune the horizontal biasing of the pad inwardly by the second beam 44 along the vertical plane B, the fulcrum 70 may be suitably adjusted by movement between the back and front ends of the arm 32. That is, the fulcrum 70 may be adjusted by loosening the bolts 74 which extend through the opening 76 and clamp the fulcrum 70 to the pad 40 by the fulcrum limit plate 78. When the bolts 74 are loosened, the anvil 72 may be moved horizontally because of the elongate slot 76 to fine tune the horizontal biasing of the second spring beam 44 in the vertical plane B. This can be done by inserting a screw driver through a slot 86 in the second beam 44 and engaging the hole 88 in the fulcrum 70 for suitably moving the anvil 72. Thereafter, when the position of the anvil 72 is selected, the bolts 74 are again tightened.

As previously mentioned, a preload effect occurs in each arm. The preload causes the arms to have the least amount of lost motion before the spring effect becomes significant. The tightening of bolts 56 creates sufficient pressure between pad 40 and outer spring 44 to place fulcrum 70 in compression. Referring to FIGS. 5A-5D, as load is applied to pad 40, fulcrum 70 applies a load $R_B$ to spring 44. Deflection of spring 44 induces a clockwise moment $M_A$ in spring 44 around pin 50 and an equal counterclockwise moment is induced in pad 40 around pin 50. This stiffens the overhang of pad 40 at the location at which load loss is most likely to occur.

The present clamp arm will reduce clamping damage and will efficiently lift, transport and deposit the most difficult to handle unitized case loads. The present clamp will handle unit loads of small dimension and dense case sizes that were previously deemed unclampable. Unlike conventional carton clamps, the present clamp arm does not crimp any part of the load, and with zero degree arm camber and toe-in, the arms 32 and 34 apply equal pressure over the entire pad area meaning that every tier of the load supports it own weight. Unlike articulating arm designs, the present arms not only implement a vertical, but also the more important horizontal (front to back) distribution of pressure on the load/cases.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts may be made without departing from the spirit of the invention and the scope of the appended claims.

What is claimed is:

1. In a carton clamp arm in a load carrying clamp attachment for use on a lift truck, said arm having an arm back end and an arm front end, an inner side and an outer side, said arm back end supported from a slide, and said inner side positioned to engage a load, the improvement in the arm comprising, a pad on the inner side of the arm for clamping a load, a first spring beam positioned outside of the pad and connected at a first spring beam back end to said slide, a second spring beam positioned outside of the first spring beam and connected at a second spring beam back end to said slide, a front end of said pad supported vertically and horizontally in a vertical plane adjacent front ends of the first and second spring beams, said first spring beam pivotally attached at a vertical pivot point to the second spring beam adjacent the front end of the first spring beam, and the second spring beam rigidly attached to the pad at a position between the pivot point and the front end of the pad thereby providing a back up to the front end of the pad, a back end of the pad supported vertically in a vertical plane from the first spring beam, and said back end of the pad supported horizontally in a vertical plane from the second spring beam.

2. The arm of claim 1 wherein, the front end of the pad is supported in a vertical plane adjacent to but spaced from the front end of the pad, and the back end of the pad is supported in a vertical plane adjacent to but spaced from the back end of the pad.

3. The arm of claim 1 wherein the front ends of the first and second spring beams are positioned nearer to the inside of the pad than the rear ends of the first and second spring beams.

4. The arm of claim 1 wherein the horizontal support of the back end of the pad is adjustable between the back and front ends.

5. In a carton clamp arm in a load carrying clamp attachment for use on a lift truck, said arm having a back end and a front end, an inner side and an outer side, said back end supported from a slide, and said inner side positioned to engage a load, the improvement in the arm comprising, a pad on the inner side of the arm for clamping a load, a first spring beam positioned outside of the pad and connected at a first spring beam back end to said slide, a second spring beam positioned outside of the first spring beam and connected at a second spring beam back end to said slide, a front end of said pad supported vertically and horizontally in a vertical plane adjacent front ends of the first and second spring beams, said back end of the pad supported vertically in a vertical plane from the first spring beam, a back end of the pad supported horizontally in a vertical plane from the second spring beam, and a fulcrum supported from the pad and engagable against an inner side of the second spring beam, the position of said fulcrum relative to said first and second spring beams being linearly shiftable between the ends of the arm.

6. In a carton clamp arm in a load carrying clamp attachment for use on a lift truck, said arm having a back end and a front end, an inner side and an outer side, said back end supported from a slide, and said inner side position ed to engage a load, the improvement in the arm comprising, a pad on the inner side of the arm for clamping a load, a first spring beam positioned outside of the pad and connected at a first spring beam back end to said slide, a second spring beam positioned outside of the first spring beam and connected at a second spring beam back end to said slide, a front end of said pad supported vertically and horizontally in a vertical plane adjacent front ends of the first and second spring beams, a back end of the pad supported vertically in a vertical plane from the first spring beam, said back end of the pad supported horizontally in a vertical plane from the spring beam, a fulcrum stop on the first spring beam and a fulcrum limit positioned between the first and second spring beams and connected to the pad and positioned to engage said fulcrum stop and thereby limit inward movement of the pad.

* * * * *